US008926311B1

(12) United States Patent
Schmidgall

(10) Patent No.: US 8,926,311 B1
(45) Date of Patent: Jan. 6, 2015

(54) VIBRATION SYSTEM FOR CONCRETE PIPE MAKING MACHINES

(71) Applicant: Hawkeye Concrete Products Co., Mediapolis, IA (US)

(72) Inventor: Jon A. Schmidgall, Mediapolis, IA (US)

(73) Assignee: Hawkeye Concrete Products Co., Mediapolis, IA (US)

( * ) Notice: Subject to any disclaimer, the term of this patent is extended or adjusted under 35 U.S.C. 154(b) by 122 days.

(21) Appl. No.: 13/737,251

(22) Filed: Jan. 9, 2013

(51) Int. Cl.
*B28B 21/16* (2006.01)
*B28B 1/087* (2006.01)
*B28B 7/00* (2006.01)

(52) U.S. Cl.
CPC ..... *B28B 21/16* (2013.01); *B28B 1/087* (2013.01); *B28B 7/0029* (2013.01)
USPC ..... 425/432

(58) Field of Classification Search
CPC ..... B28B 1/087; B28B 7/0029; B28B 21/14; B28B 21/16
USPC ..... 425/432
See application file for complete search history.

(56) References Cited

U.S. PATENT DOCUMENTS

| | | | | |
|---|---|---|---|---|
| 2,969,575 | A * | 1/1961 | Gagne | 425/432 |
| 4,131,408 | A | 12/1978 | Sehulster et al. | |
| 4,708,621 | A | 11/1987 | Schmidgall et al. | |
| 6,939,121 | B2 * | 9/2005 | Giri et al. | 425/432 |
| 7,083,406 | B2 | 8/2006 | Stoller et al. | |

OTHER PUBLICATIONS

"Fastener and Screw Torque Design and Equation", Engineers Edge, 2000, accessed at http://www.engineersedge.com/torque.htm on Jun. 30, 2014.*

* cited by examiner

*Primary Examiner* — Alison Hindenlang
(74) *Attorney, Agent, or Firm* — Jason R. Sytsma; Shuttleworth & Ingersoll, PLC

(57) ABSTRACT

A vibration system for concrete pipe making machines using the dry cast method and which employ adjustable molds comprised of corner panels joined to intermediate panels. Two coupled vertically spaced-apart vibrators are mounted in two opposite corner panels of the mold core. The vibrators are mounted on shelves welded to the interior of the walls that form the mold surface. The shelves are also welded to vertical end walls that extend inwardly to form the box-like corner panel. The corner panels and intermediate panels are secured together by removable fasteners that join the vertical end walls of the corner panels to the corresponding vertical end walls of the side panels. The joined corner panels and side panels provide a rigid core structure similar to a solid core and allow the entire core to become the vibration structure.

14 Claims, 6 Drawing Sheets

VIBRATION SYSTEM FOR CONCRETE PIPE MAKING MACHINES

BACKGROUND OF THE INVENTION

This invention relates to machines and processes for manufacturing concrete products, such as concrete pipe, manholes, catch basins, and the like, and more specifically, the invention relates to the "dry-cast" method of manufacturing concrete products which requires a system for providing vibration to the core and jacket of the concrete mold during the fill and pressure-head cycles of the manufacturing process.

In the dry-cast method of manufacturing, concrete vibration is necessary to consolidate and compact the concrete in the mold prior to curing. The inner mold, or core, of a concrete product mold therefore contains a vibration system which normally consists of eccentric weights mounted on a central shaft, or in some cases vibrators can be mounted on opposite sides of a rigid core for making rectangular shaped products. In any case, the vibrators are typically driven by electric or hydraulic motors. An example of a dry cast concrete pipe making machine using a central vibration system for a round concrete product is show in U.S. Pat. No. 4,708,621. As shown in this patent, the core is rigid and is used for producing a product of a particular size.

Manufacturers of concrete products typically produce products in different shapes and sizes which require the manufacturers to purchase and maintain jackets and rigid cores of different sizes. For rectangular shaped products, there are known and available adjustable forms which are panels secured together so that the form can be increased or decreased in size when desired by changing panels. However, when adjustable forms having removable panels are used, central core vibration systems have not been successfully used because the vibration will cause the panels that form the core to loosen and separate.

Therefore, when adjustable forms are used, the common and most economical vibration system that is currently used is a system in which small individual vibrators are mounted on both the jacket and the core. (FIG. 2 of the drawing shows an example of this on the jacket). When using this prior art method, the jacket and core form set must be built flexible enough to allow the vibrators to flex the structure and thereby transmit the vibration to the concrete. If the form set is built too rigid, it will not vibrate properly. The problem with building the form set flexible enough to vibrate the concrete, is that when concrete is placed in the form, the form begins to bow at the center of the sides. This is not desired as it leaves bows in the center of the product walls which create point contact at the center of the span when the product is installed in the field. It also leaves larger than desired gaps between the top and bottom joint rings and the product wall, which gap creates undesirable fins when the joint rings and form set is removed during the final steps of the concrete pipe manufacturing process.

Another problem with this known vibration system for adjustable forms is that it does not provide adequate vibration to properly compact the concrete. This inadequate vibration contributes to a condition that has been termed "slabbing off".

There is therefore a need for an improved vibration system for adjustable cores that will provide advantages over the existing prior art systems.

SUMMARY OF THE INVENTION

The invention provides for a vibration system for adjustable cores for concrete making dry cast machines. Two vertically spaced-apart coupled vibrators are mounted in two opposite corner panels of the core. The vibrators are mounted on shelves welded to the exterior walls that form the mold core. The shelves are also welded to vertical end walls that extend inwardly to form the box-like corner panel. The vertical end walls provide for solid connection to similar end walls on the adjacent side panels. The shelves are reinforced by gussets that are welded to the exterior walls. The corner panels and side panels are secured together by removable fasteners that join the vertical end walls of the corner panels to the corresponding vertical end walls of the side panels. Where the fasteners extend through preformed openings in the vertical supports, bow-tie reinforcements are welded to the inside surfaces of the vertical end walls. Then the fasteners are torqued to at least 400 ft.-lbs. With the invention, both the jacket and core are built rigid enough so they will not bow when filled with concrete. The large vibrators mounted on opposite corners of the rigid core will shake the entire core mass. In building an adjustable core with corner panels and side panels that provide a rigid core structure similar to a solid core, a superior more uniform vibration system is created that vibrates the entire core mass rather than a non-uniform flexing the skin of the core. When the rigid core of the invention is used on conjunction with a jacket mounted with small individual vibrators as shown in FIG. 2, this system compacts the concrete better than known prior art systems.

DESCRIPTION OF THE PREFERRED EMBODIMENTS OF THE INVENTION

Figure 1:
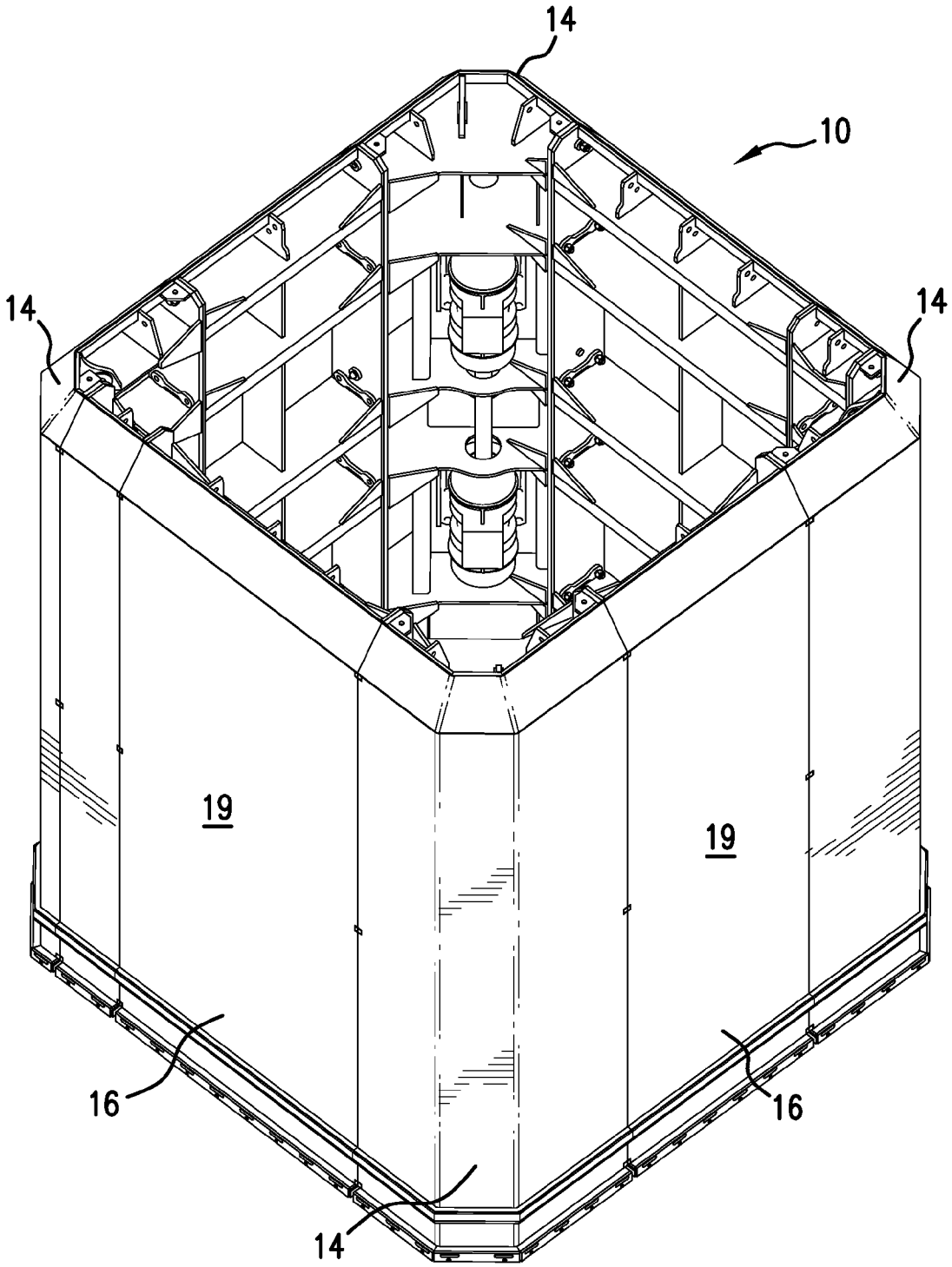
FIG. 1 is a perspective view of an adjustable core for a square mold of a pipe making machine with the vibration system of the invention in place.

Referring first to FIG. 1, there is shown an adjustable inner core 10 for a form or mold for producing a square-shaped concrete pipe, for example. As will be understood by those skilled in the art, the core 10 is combined with a jacket 12 (FIG. 2) to create an annular space between them into which space concrete is poured to form the concrete pipe. The core 10 includes corner panels 14 joined to side panels 16 all of which panels have flat, smooth exterior surfaces 19. As shown in FIG. 1, panels 16 are sized to produce a core for square pipe, and when the panels are joined together as shown in FIG. 1, they make up the core 10. When the core 10 is properly positioned inside the jacket 12 and placed on a base (not shown), the core 10 and jacket 12 comprise a mold for the concrete product. As will be understood by those skilled in the art, depending on the manufacturer's production method, the core 10 and jacket 12 either rest on a structure that is a part of the manufacturers pipe making machine or they rest on the concrete floor of the factory where the pipe is being produced.

Also, the core 10 and jacket 12 can be of an elliptical, rectangular or other geometric configuration depending upon the type of concrete pipe being produced.

Figure 3:
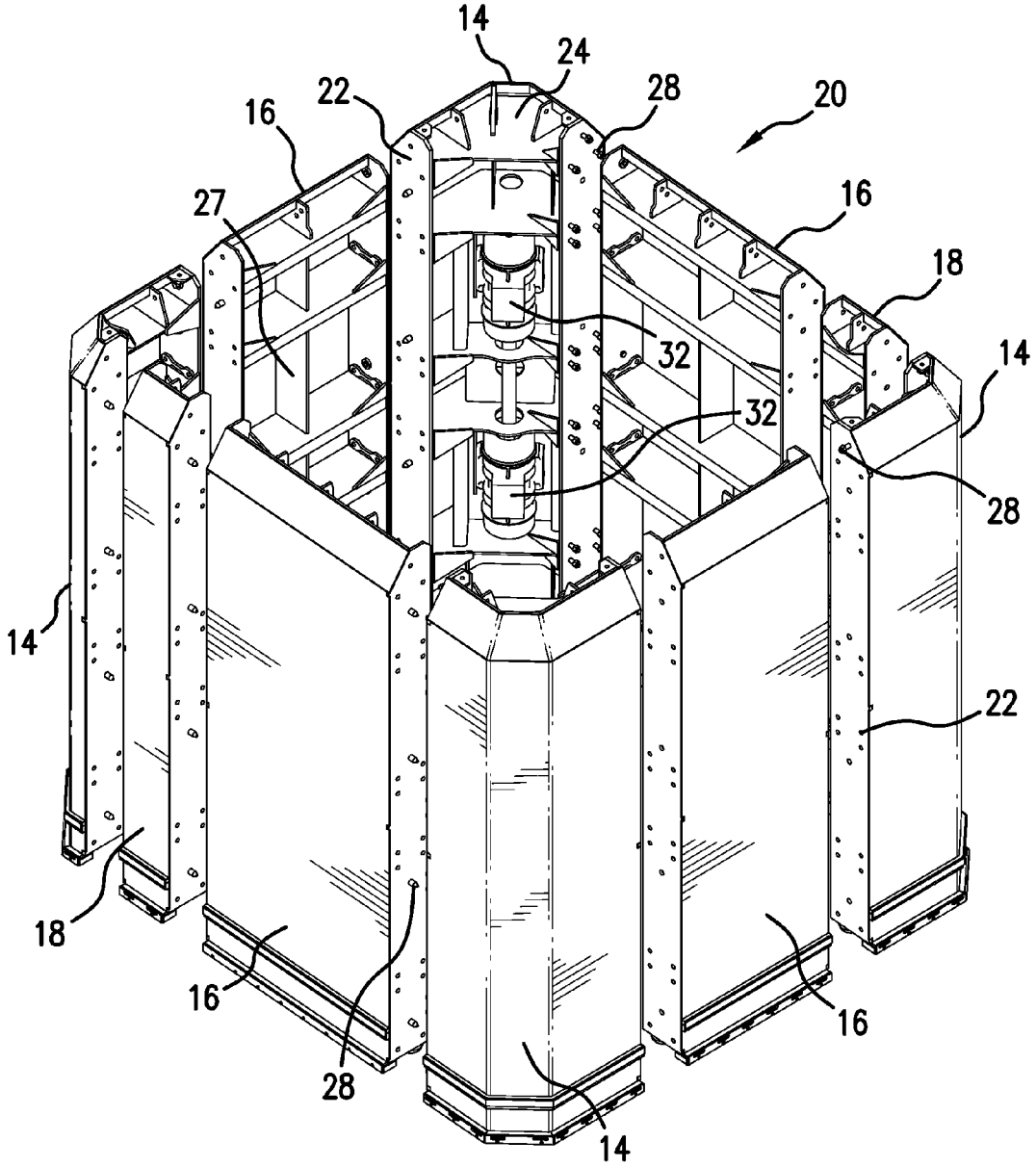
FIG. 3 is a perspective view similar to FIG. 1 but showing an adjustable core for a rectangular mold of a pipe making machine showing the panels separated and with the vibration system of the invention in place.
Figure 4:
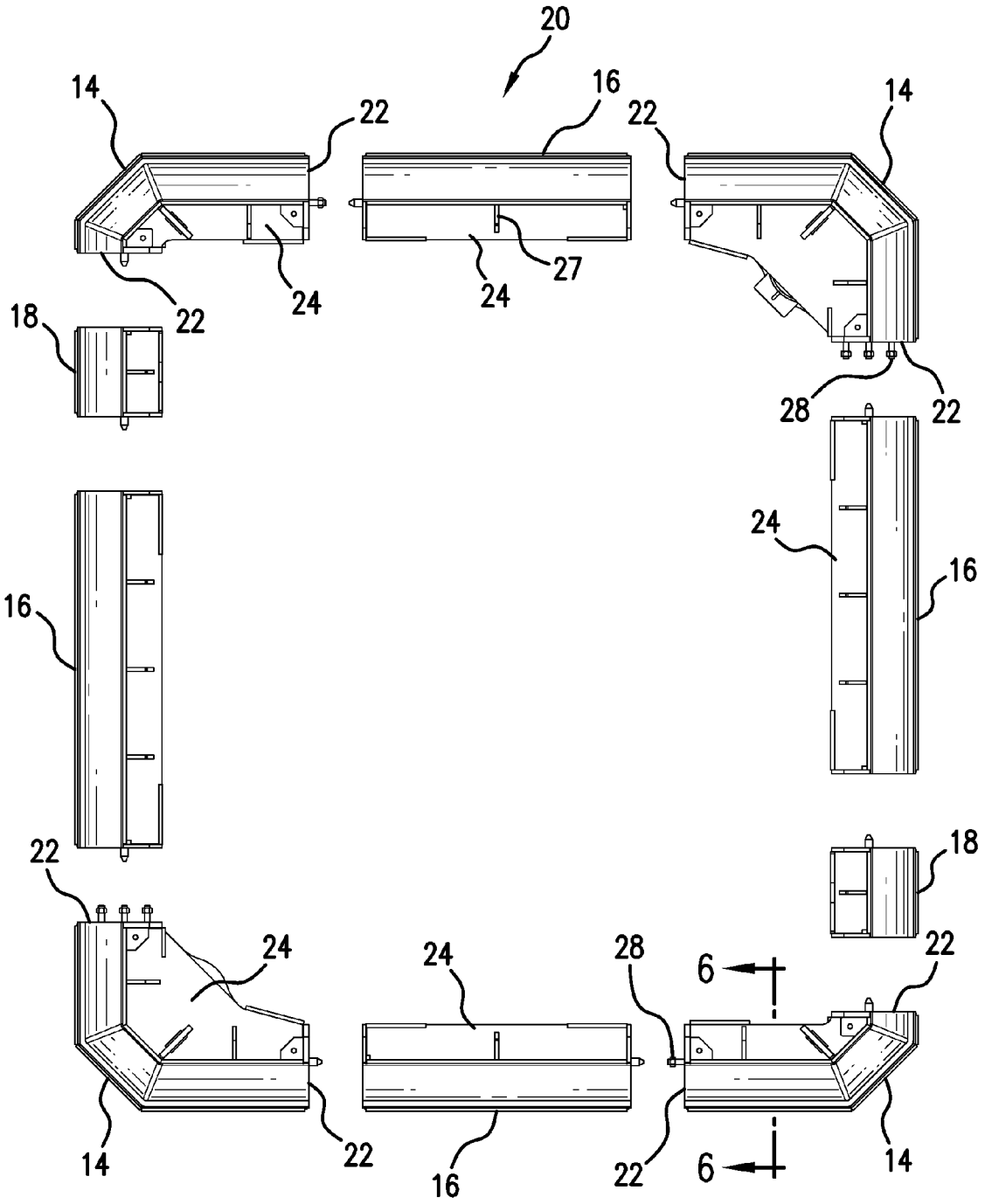
FIG. 4 is a top view of the adjustable core of FIG. 3 with the panels shown separated and showing the additional side panels for a rectangular core.

FIGS. 3 and 4 show an adjustable core 20 similar to the core 10 but having panels sized for producing a concrete product of a rectangular shape. Each corner panel 14 and each side panel 16 are similarly constructed for structural integrity, and to form a rectangular core, additional side panels 18 are inserted between a corner panel 14 and a side panel 16 along two opposite sides.

Figure 5:
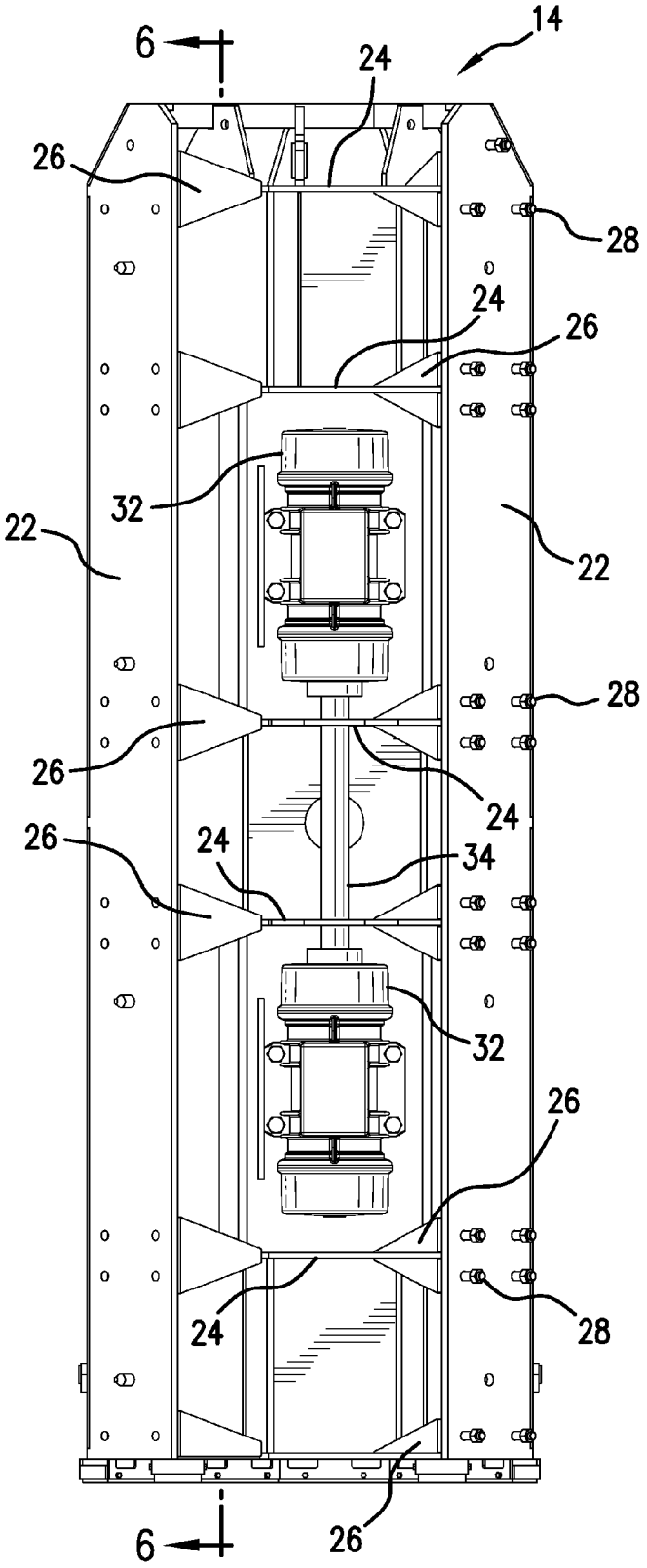
FIG. 5 is a side view of a corner panel of the adjustable mold of FIG. 1 or 3 viewing the panel from the inside.

FIG. 5 is a view of a corner panel 14 and clearly illustrates that the panel 14 has at its ends vertical walls 22 that extend from the top to the bottom of the panel 14 and interior vertically-spaced-apart horizontal shelves 24 with gusset plates 26 that provide additional structural support for each panel. Each side panel 16 similarly has at its ends vertical walls 22 and shelves 24 reinforced by gusset plates 26. Because the side panels 16 are somewhat larger than the corner panels 14, additional strength may be provided by vertical reinforcing members 27 extending between the shelves 24 centrally of the vertical end walls 22 (See FIG. 3). The components that comprise each panel 14, 16 or 18 are preferably welded together to form a solid structure.

Figure 6:
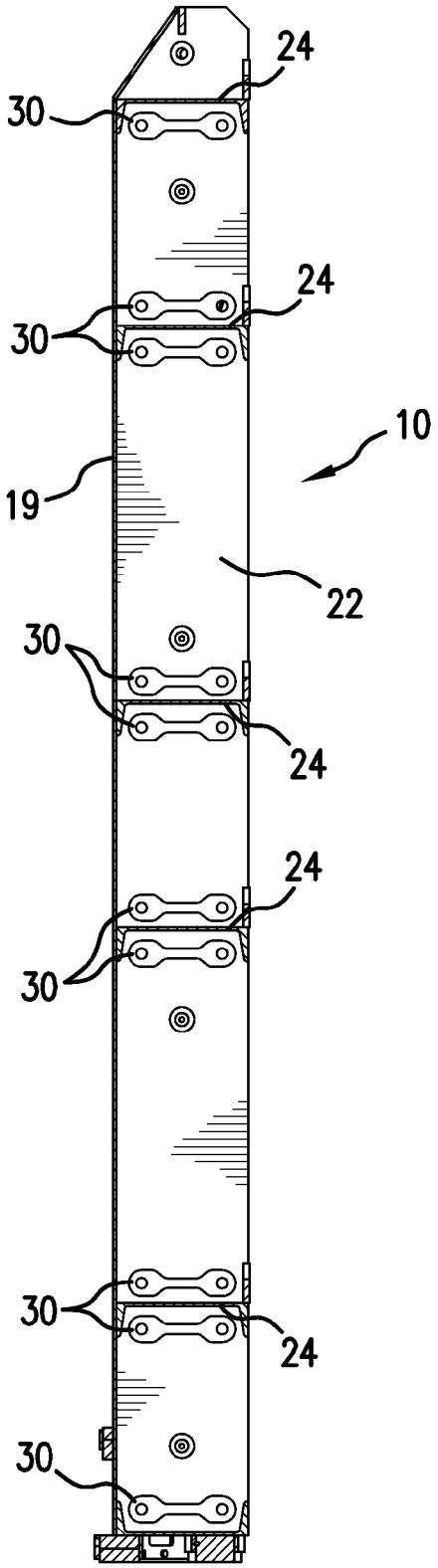
FIG. 6 is a sectional view taken on the line 6-6 of FIGS. 4 and 5.

To form the core 10 (or core 20 in the case of a rectangular core), the corner panels 14 are secured to the side panels 16 by suitable fasteners, such as threaded members 28 that are torqued to 400 ft.lbs. As best seen in FIG. 6, the members 28 extend through bowtie plates 30 welded to the inside surfaces of the vertical walls 22. The bowtie plates 30 add to the structural integrity and rigidity of the cores 10 or 20.

Mounted inside of two of the opposing corner panels 14 are a pair of vibrator assemblies 32. The vibrator assemblies 32 are spaced apart as best seen in FIGS. 3 and 5 and are coupled together by shaft 34. The four vibrator assemblies 32 are capable of vibrating the entire core 10 or 20 rather than flexing the individual panels that comprise the core. Vibrating the entire core mass compacts the concrete in the mold and especially improves corner compaction.

Figure 2:
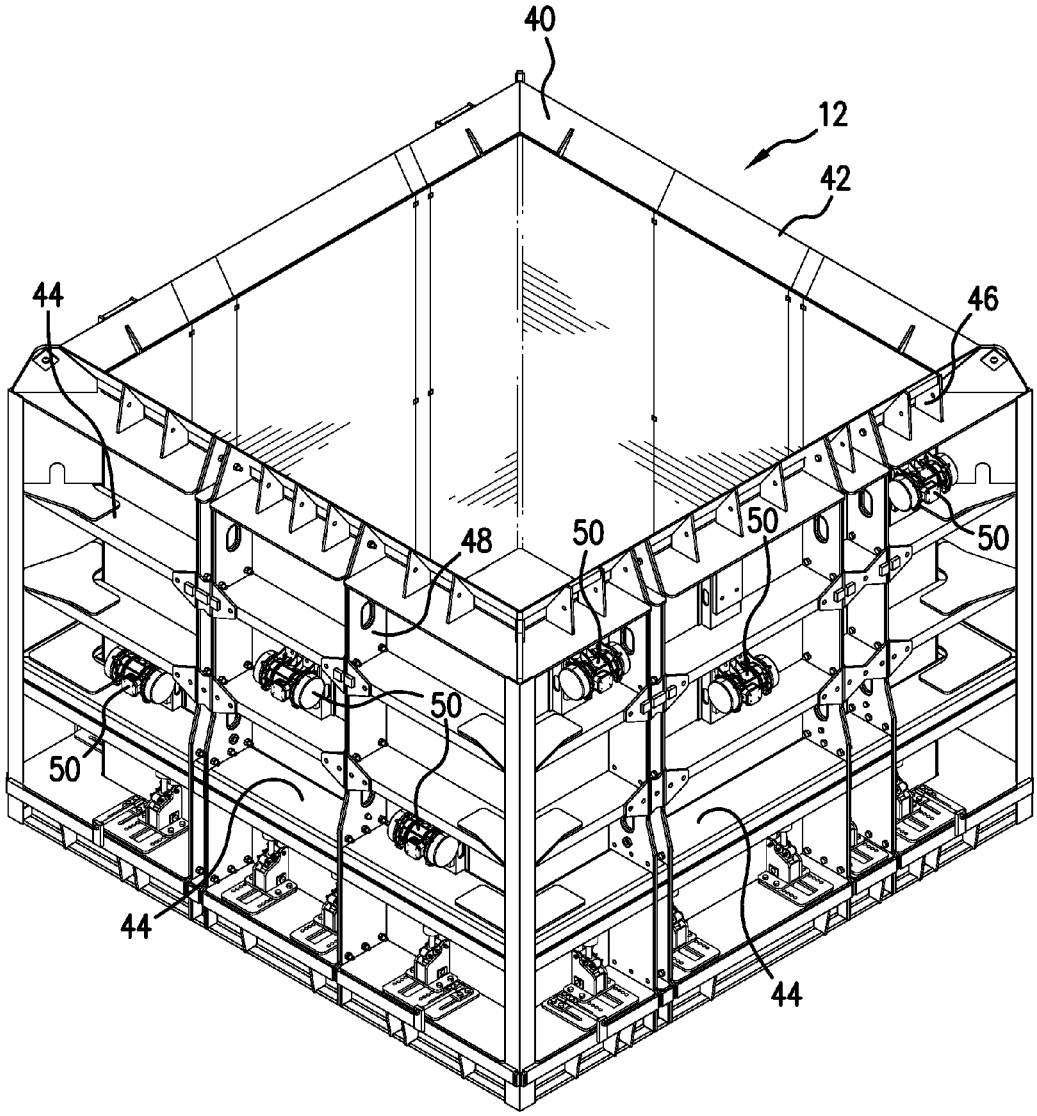
FIG. 2 a perspective view of a jacket for a square mold of a pipe making machine showing the jacket vibration system.

Referring now to FIG. 2, there is illustrated a typical adjustable jacket 12 comprised of corner panels 40 and side panels 42. Each panel 40 and 42 is provided with vertically spaced-apart shelves 44 which are further reinforced by gussets 46 where needed. Each panel 40 and 42 has a vertical end wall 48, with the end walls of the panels 40 and 42 being secured together in any suitable manner, similar to the panels that comprise the cores 10 and 20. As illustrated in FIG. 2, vibrator assemblies 50 are mounted on each panel 40 and 42.

From the above description, it will be evident that the vibration system of the invention has numerous advantages over prior art systems. By combining the vibration of the adjustable jacket 12 with the corner vibration system of the adjustable core 10, a superior concrete product is produced with a very smooth inside surface which is highly desired by manufacturers of concrete pipe. Since a single manufacturer typically makes concrete products of different sizes thus requiring molds of different sizes, the principles of the invention applied to adjustable cores provides considerable cost savings by eliminating the necessity of purchasing cores and jackets of different sizes. By using the same corner panels and combining them with intermediate panels to create a form for the desired pipe size, a variety of pipe sizes can be produced.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. An adjustable mold for the manufacture of concrete products, said mold comprising:

an outer jacket having corner panels joined to intermediate panels, the intermediate panels being separable from the corner panels;

the corner panels and the intermediate panels of the jacket having inner walls that have substantially smooth surfaces;

an inner core positioned inside and space from inner walls of the jacket to form an annular space into which concrete can be poured to form the concrete product;

the inner core having corner panels joined by intermediate panels, the intermediate panels being separable from the corner panels;

the corner panels and the intermediate panels of the inner core having rigidly attached outer walls that have substantially smooth surfaces;

the smooth surfaces of the inner walls of the outer jacket and the smooth surfaces of the outer walls of the inner core forming the mold for the concrete product when the inner mold is positioned inside the jacket;

a plurality of vibrators mounted on the jacket so as to vibrate the entire jacket when the corner panels and intermediate panels are secured together; and a pair of vertically spaced apart vibrators mounted on each of two opposite corner panels of the inner core, the vibrators being capable of vibrating the entire inner core.

2. The adjustable mold of claim 1 in which the corner panels and intermediate panels of the inner core each have vertical ends walls and vertically spaced apart horizontal shelves extending between the end walls, the shelves and end walls being reinforced with gusset plates.

3. The adjustable mold of claim 2 in which the corner panels and intermediate panels are secured together by fasteners extending through the end walls of adjoining panels.

4. The adjustable mold of claim 3 in which the fasteners are threaded members and the members are torqued to about 400 ft.lbs.

5. The adjustable mold of claim 4 in which bowtie plates are welded to the end walls of the adjoining corner panels and intermediate panels at the point where the fasteners join the end walls.

6. The adjustable mold of claim 1, wherein the plurality of vibrators mounted on the jacket flex the panels of the jacket and the vibrators mounted on the inner core shake the entire inner core mass as an integral unit.

7. An adjustable core in a mold for the manufacture of concrete products, the adjustable core comprising:

a plurality of modular sections each of which having a substantially smooth outer panel rigidly attached to the modular section in a manner that minimizes flexing of the outer panel and such that when the modular sections are combined together a smooth outer perimeter is formed which is used to form an inner surface of the concrete product;

a first vibrator mounted to one of the modular sections; and a second vibrator mounted to another one of the modular sections and positioned opposite from the first vibrator, wherein the first vibrator and the second vibrator cooperate to vibrate the adjustable core.

8. The adjustable core of claim 7, and further comprising a third vibrator connected to the first vibrator and a fourth vibrator connected to the second vibrator.

9. The adjustable core of claim 8, and further comprising a first shaft to couple the first vibrator to the third vibrator and a second shaft to couple the second vibrator to the fourth vibrator, wherein the first vibrator, the second vibrator, the third vibrator, and the fourth vibrator have a sufficient power to shake the core as an integral unit.

10. The adjustable core of claim 7, wherein the combined plurality of modular sections form one of a square and a rectangle, wherein the first vibrator is mounted to the modular section positioned on a first corner and the second vibrator is mounted to the modular section on the opposite corner, and wherein the first vibrator and the second vibrator rotate counter with respect to each other.

11. The adjustable core of claim 10, wherein no vibrators are mounted on any other modular section of the plurality of modular sections other than the modular sections of claim 9 to avoid cancelling out vibrations created by the first vibrator and the second vibrator.

12. The adjustable core of claim 10, wherein the modular section positioned on the first corner is a first corner modular section and the modular section positioned on the opposite corner is a second corner modular section, wherein the first corner modular section and the second corner modular section each further comprise a first end wall and a second end wall with a plurality of structural supports for reinforcement between the first end wall and the second end wall.

13. The adjustable core of claim 12, wherein the structural supports further comprise a shelf between the first end wall and the second end wall with a gusset attaching a top side of the shelf to the first end wall a gusset attaching a bottom side of the shelf to the first end wall a gusset attaching a top side of the shelf to the second end wall and a gusset attaching a bottom side of the shelf to the second end wall.

14. The adjustable core of claim 7, wherein each modular section is a rigid structure that allows for substantially no flexion of the smooth outer panel, and wherein the rigid core mass vibrates as an integral unit.

* * * * *